US011076704B2

(12) United States Patent
Bellingroth

(10) Patent No.: US 11,076,704 B2
(45) Date of Patent: Aug. 3, 2021

(54) MOTORIZED BED

(71) Applicant: SINO INTERNATIONAL GROUP LIMITED, Monkok KL (HK)

(72) Inventor: Klaus Bellingroth, Gummersbach (DE)

(73) Assignee: SINO INTERNATIONAL GROUP LIMITED, Hongkong (CN)

( * ) Notice: Subject to any disclaimer, the term of this patent is extended or adjusted under 35 U.S.C. 154(b) by 849 days.

(21) Appl. No.: 15/353,622

(22) Filed: Nov. 16, 2016

(65) Prior Publication Data

US 2018/0132625 A1 May 17, 2018

(51) Int. Cl.

| | |
|---|---|
| ***A47C 20/04*** | (2006.01) |
| ***A47C 19/02*** | (2006.01) |
| ***A47C 19/12*** | (2006.01) |

(52) U.S. Cl.

CPC ..... *A47C 20/041* (2013.01); *A47C 19/025* (2013.01); *A47C 19/122* (2013.01); *A47C 20/04* (2013.01)

(58) Field of Classification Search

CPC ..... A47C 19/025; A47C 19/122; A47C 20/04; A47C 20/041; A47C 20/00–18; A47C 20/042; A47C 20/048; A47C 20/06; A61G 7/002; A61G 7/005; A61G 7/015; A61G 7/018

See application file for complete search history.

(56) References Cited

U.S. PATENT DOCUMENTS

| | | | | |
|---|---|---|---|---|
| 1,253,625 A * | 1/1918 | Morphis | ..... | A47C 19/025 5/305 |
| 2,607,929 A | 8/1952 | Balluff | | |
| 3,138,805 A | 6/1964 | Piazza | | |
| 3,281,141 A | 10/1966 | Smiley et al. | | |
| 3,754,749 A | 8/1973 | Lyon et al. | | |

(Continued)

FOREIGN PATENT DOCUMENTS

| | | | | |
|---|---|---|---|---|
| CN | 202681242 | 1/2013 | | |
| DE | 202015100221 U1 * | 3/2015 | ..... | A47C 20/041 |

(Continued)

OTHER PUBLICATIONS

DE-202016001835-U1 English Translation (Year: 2016).*

(Continued)

*Primary Examiner* — Peter M. Cuomo
*Assistant Examiner* — Amanda L Bailey
(74) *Attorney, Agent, or Firm* — Andrew C. Cheng

(57) ABSTRACT

A motorized bed includes a bed frame, a foot rest, a footrest actuator, a backrest, a backrest actuator, and a linkage part. The bed frame includes a first cross bar and a second cross bar. The footrest is rotatably mounted to the bed frame. The footrest actuator is mounted between the footrest and the first cross bar and configured to drive the footrest to rotate relative to the bed frame. The backrest is rotatably mounted to the bed frame. The backrest actuator is mounted between the backrest and the second cross bar and configured to drive the backrest to rotate relative to the bed frame. The linkage part is fixedly connected between the first cross bar and the second cross bar such that a force introduced by either of the footrest motor and the backrest motor is supported by both of the first cross bar and the second cross bar.

12 Claims, 4 Drawing Sheets

(56) References Cited

U.S. PATENT DOCUMENTS

| | | | | |
|---|---|---|---|---|
| 4,057,240 | A | 11/1977 | Damico et al. | |
| 4,062,074 | A | 12/1977 | Holland | |
| 4,103,170 | A | 7/1978 | Spradlin | |
| 4,349,924 | A | 9/1982 | Zur | |
| D288,874 | S | 3/1987 | Yosimoto | |
| 4,813,088 | A | 3/1989 | DiMatteo et al. | |
| 4,987,620 | A | 1/1991 | Sharon | |
| 5,095,561 | A | 3/1992 | Green et al. | |
| D341,039 | S | 11/1993 | Losagio | |
| 5,369,825 | A | 12/1994 | Reesby | |
| 5,544,375 | A | 8/1996 | Urness et al. | |
| 5,555,582 | A | 9/1996 | Jerideau | |
| 5,628,078 | A | 5/1997 | Pennington et al. | |
| D384,834 | S | 10/1997 | Midorikawa et al. | |
| 6,272,702 | B1 | 8/2001 | Uchida et al. | |
| 6,584,629 | B2 | 7/2003 | Tsuji et al. | |
| 6,742,206 | B1 | 6/2004 | Han | |
| 6,961,971 | B2 | 11/2005 | Schneider et al. | |
| 6,986,180 | B1 | 1/2006 | Wilke | |
| 7,036,165 | B2 | 5/2006 | Weinman et al. | |
| 7,325,265 | B2 | 2/2008 | Hornbach et al. | |
| D645,273 | S | 9/2011 | Sakakibara et al. | |
| D645,274 | S | 9/2011 | Sakakibara et al. | |
| 8,091,165 | B2 | 1/2012 | Mossbeck | |
| 8,474,075 | B2 | 7/2013 | Kawakami et al. | |
| 8,516,630 | B2 | 8/2013 | Gugliotti et al. | |
| 8,677,523 | B2 | 3/2014 | Tsukada et al. | |
| 8,683,629 | B2 | 4/2014 | Clenet et al. | |
| 8,707,478 | B2 * | 4/2014 | Jin | A47C 19/04 5/112 |
| 9,049,939 | B2 | 6/2015 | Viberg | |
| 9,414,980 | B2 | 8/2016 | Kume | |
| 9,414,981 | B2 | 8/2016 | Tsukada et al. | |
| 9,462,881 | B2 | 10/2016 | Wang | |
| 9,517,172 | B2 | 12/2016 | Kume | |
| RE46,367 | E | 4/2017 | Estrada et al. | |
| D784,718 | S | 4/2017 | Bellingroth et al. | |
| 9,649,234 | B2 | 5/2017 | Kume | |
| 9,849,054 | B2 | 12/2017 | Jackson | |
| 2002/0144350 | A1 | 10/2002 | Shih | |
| 2002/0162410 | A1 | 11/2002 | Zimmerman | |
| 2002/0178502 | A1 | 12/2002 | Beasley et al. | |
| 2003/0183027 | A1 | 10/2003 | Koch | |
| 2004/0129844 | A1 | 7/2004 | Doyle | |
| 2004/0187213 | A1 | 9/2004 | Wang | |
| 2005/0274303 | A1 | 12/2005 | Kurt et al. | |
| 2006/0279143 | A1 | 12/2006 | Platz | |
| 2007/0083993 | A1 * | 4/2007 | Lindner | A47C 19/045 5/611 |
| 2007/0180620 | A1 | 8/2007 | Bellingroth | |
| 2008/0289545 | A1 | 11/2008 | Picchio | |
| 2010/0325800 | A1 | 12/2010 | Huang | |
| 2012/0169093 | A1 | 7/2012 | Kume et al. | |
| 2013/0191993 | A1 | 8/2013 | Rawls-Meehan | |
| 2014/0053340 | A1 | 2/2014 | Viberg | |
| 2014/0082835 | A1 | 3/2014 | Husslage | |
| 2014/0191541 | A1 | 7/2014 | Ohta et al. | |
| 2014/0319804 | A1 | 10/2014 | Tsukada et al. | |
| 2014/0327232 | A1 | 11/2014 | He | |
| 2014/0360415 | A1 | 12/2014 | Riis et al. | |
| 2015/0082537 | A1 | 3/2015 | Ohta et al. | |
| 2015/0121623 | A1 * | 5/2015 | Huang | A61G 7/018 5/616 |
| 2015/0297431 | A1 * | 10/2015 | Rawls-Meehan | A61G 7/018 5/617 |
| 2015/0313369 | A1 * | 11/2015 | Tarplee | A61H 23/0254 601/57 |
| 2015/0320213 | A1 | 11/2015 | Todd | |
| 2015/0320627 | A1 | 11/2015 | Tsukada et al. | |
| 2016/0120719 | A1 | 5/2016 | Bellingroth | |
| 2016/0128885 | A1 | 5/2016 | Latney | |
| 2018/0000253 | A1 | 1/2018 | Bellingroth | |
| 2018/0008049 | A1 * | 1/2018 | Shih | A47C 20/041 |
| 2018/0064259 | A1 * | 3/2018 | Shih | A47C 17/86 |
| 2018/0110340 | A1 * | 4/2018 | Rawls-Meehan | A47C 20/041 |
| 2018/0140087 | A1 | 5/2018 | Wu | |
| 2018/0172062 | A1 | 6/2018 | Hu et al. | |

FOREIGN PATENT DOCUMENTS

| | | | | |
|---|---|---|---|---|
| DE | 202014000494 U1 * | 4/2015 | | A47C 20/041 |
| DE | 202016001835 U1 * | 4/2016 | | A47C 20/041 |
| DE | 202016101121 U1 * | 4/2016 | | A47C 1/0242 |
| EP | 1438911 A2 * | 7/2004 | | A47C 20/041 |

OTHER PUBLICATIONS

DE-202014000494-U1 English Translation (Year: 2015).*
DE-202015100221-U1 English Translation (Year: 2015).*
DE-202016101121-U1 English Translation (Year: 2016).*
Elevation Comfort Base Adjustable Bed, Glideaway.com, site visited Aug. 24, 2016, available from internet, <URL:http://glideaway.com/product/elevation-comfort-base-adjustable-bed/ 8/>.

* cited by examiner

MOTORIZED BED

FIELD

The present invention relates to a motorized mechanism and, in particular, to a motorized bed with low cost.

BACKGROUND

A motorized leisure bed usually includes a platform supported by a bed frame. The platform has a footrest and a backrest to be driven to lift or rotate by their respective actuators. Price is an important factor to consider when buying a leisure bed, especially in the entry level market. One approach of reducing cost is to reduce material cost by reducing the wall thickness of tubes used in the bed frame.

Using tubes with thinner walls has consequences, mainly in two areas. First, the supporting bed frame is not strong enough to support the payload (mattress and user) if supported by legs in the four corners, only. Therefore, typically additional legs are required in the middle of the bed, in addition to the legs at the corners of the bed. Conventionally, the additional legs are arranged on the middle of the outsides of the bed, which results in a poor appearance of the bed and may hinder the leg of a user beside the bed. Second, if the wall thickness of cross tubes in the bed supporting the actuators to operate the backrest and footrest is reduced to drive down cost further, these tubes may not be able to resist the forces applied by the actuators and bend.

What is needed, therefore, is a low cost bed with improved structural strength.

SUMMARY

Accordingly, the present invention is directed to a motorized bed with improved structural strength.

In one aspect, a motorized bed is provided which includes a bed frame, a foot rest, a footrest actuator, a backrest, a backrest actuator, and a linkage part. The bed frame includes a first cross bar and a second cross bar. The footrest is rotatably mounted to the bed frame. The footrest actuator is mounted between the footrest and the first cross bar and configured to drive the footrest to rotate relative to the bed frame. The backrest is rotatably mounted to the bed frame. The backrest actuator is mounted between the backrest and the second cross bar and configured to drive the backrest to rotate relative to the bed frame. The linkage part is fixedly connected between the first cross bar and the second cross bar such that a force introduced by either of the footrest motor and the backrest motor is supported by both of the first cross bar and the second cross bar.

In one embodiment, the linkage part is located at a middle area of the motorized bed.

In one embodiment, the footrest actuator and the backrest actuator are offset from each other in a length direction of the motorized bed.

In one embodiment, the footrest actuator connects to the first cross bar at a first fixation point, the backrest actuator connects to the second cross bar at a second fixation point, and the linkage part is in line with one of the first fixation point and the second fixation point while being offset from the other of the first fixation point and the second fixation point.

In one embodiment, the linkage part is in line with the second fixation point while being offset from the first fixation point.

In one embodiment, the footrest actuator connects to the first cross bar at a first fixation point, the backrest actuator connects to the second cross bar at a second fixation point, the linkage part connects to the first cross bar at a connection point close to the first fixation point and connects to the second cross bar at a connection point close to the second fixation point.

In one embodiment, the motorized bed further comprises a fixed section between the footrest and the backrest, the fixed section is fixedly mounted on the bed frame, and the linkage part is located beneath the fixed section.

In one embodiment, each of the first and second cross bars and the linkage part is tubular.

In one embodiment, the backrest comprises a mounting end rotatably mounted to the bed frame and a free end opposite to the mounting end, the second cross bar comprises an extension extending from a substantially middle portion thereof toward the first cross bar, a supporting piece fixedly connected with a substantially middle portion of the mounting end of the backrest is rotatably connected with the extension, and the linkage part is fixedly connected with the extension.

In one embodiment, the linkage part and the extension are both tubular and are end-to-end connected to each other.

In one embodiment, the linkage part reaches from the first cross bar directly to the second cross bar.

In one embodiment, the backrest comprises a mounting end rotatably mounted to the bed frame and a head end opposite to the mounting end, and a supporting piece fixedly connected with a substantially middle portion of the mounting end of the backrest is rotatably connected with the linkage part.

In another aspect, a motorized bed is provided which includes a foot half, and a head half fixedly connected to the foot half, and a linkage part. The foot half includes a first bed frame section with a first cross bar, a footrest rotatably mounted to the first bed frame section, and a footrest actuator mounted to the first cross bar and configured to drive the footrest to rotate relative to the first bed frame section. The head half includes a second bed frame section with a second cross bar, a backrest rotatably mounted to the second bed frame section, and a backrest actuator mounted to the second cross bar and configured to drive the backrest to rotate relative to the second bed frame section. The first bed frame section coupled to the second bed frame section. The linkage part is fixedly connected between the first cross bar and the second cross bar.

In one embodiment, the linkage part is located at a middle area of the motorized bed.

In one embodiment, the footrest actuator and the backrest actuator are offset from each other in a length direction of the motorized bed.

In one embodiment, the footrest actuator connects to the first cross bar at a first fixation point, the backrest actuator connects to the second cross bar at a second fixation point, and the linkage part is in line with one of the first fixation point and the second fixation point while being offset from the other of the first fixation point and the second fixation point.

In one embodiment, the linkage part is in line with the second fixation point while being offset from the first fixation point.

In one embodiment, the footrest actuator connects to the first cross bar at a first fixation point, the backrest actuator connects to the second cross bar at a second fixation point, the linkage part connects to the first cross bar at a connection point close to the first fixation point and connects to the second cross bar at a connection point close to the second fixation point.

In still another aspect, a motorized bed is provided which includes a bed frame, a footrest, a footrest actuator, a backrest, a backrest actuator, and a linkage part. The bed frame includes a substantially rectangular frame body, a first cross bar and a second cross bar connected to the frame body, and supporting legs arranged at corners of the frame body. A footrest is rotatably mounted to the frame body. The footrest actuator is mounted to the first cross bar and configured to drive the footrest to rotate relative to the bed frame. The backrest rotatably mounted to the bed frame. The backrest actuator is mounted to the second cross bar and configured to drive the backrest to rotate relative to the bed frame. The linkage part has one end fixedly connected to the first cross bar and the other end fixedly connected to the second cross bar, the linkage part located at a substantially middle area of the motorized bed. An additional leg is connected to the linkage part to support the substantially middle area of the motorized bed.

In one embodiment, the footrest actuator and the backrest actuator are offset from each other in a length direction of the motorized bed. The footrest actuator connects to the first cross bar at a first fixation point, the backrest actuator connects to the second cross bar at a second fixation point, and the linkage part is in line with one of the first fixation point and the second fixation point while being offset from the other of the first fixation point and the second fixation point.

Other independent aspects of the invention will become apparent by consideration of the detailed description, claims and accompanying drawings.

DESCRIPTION OF THE EMBODIMENTS

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

Figure 1:
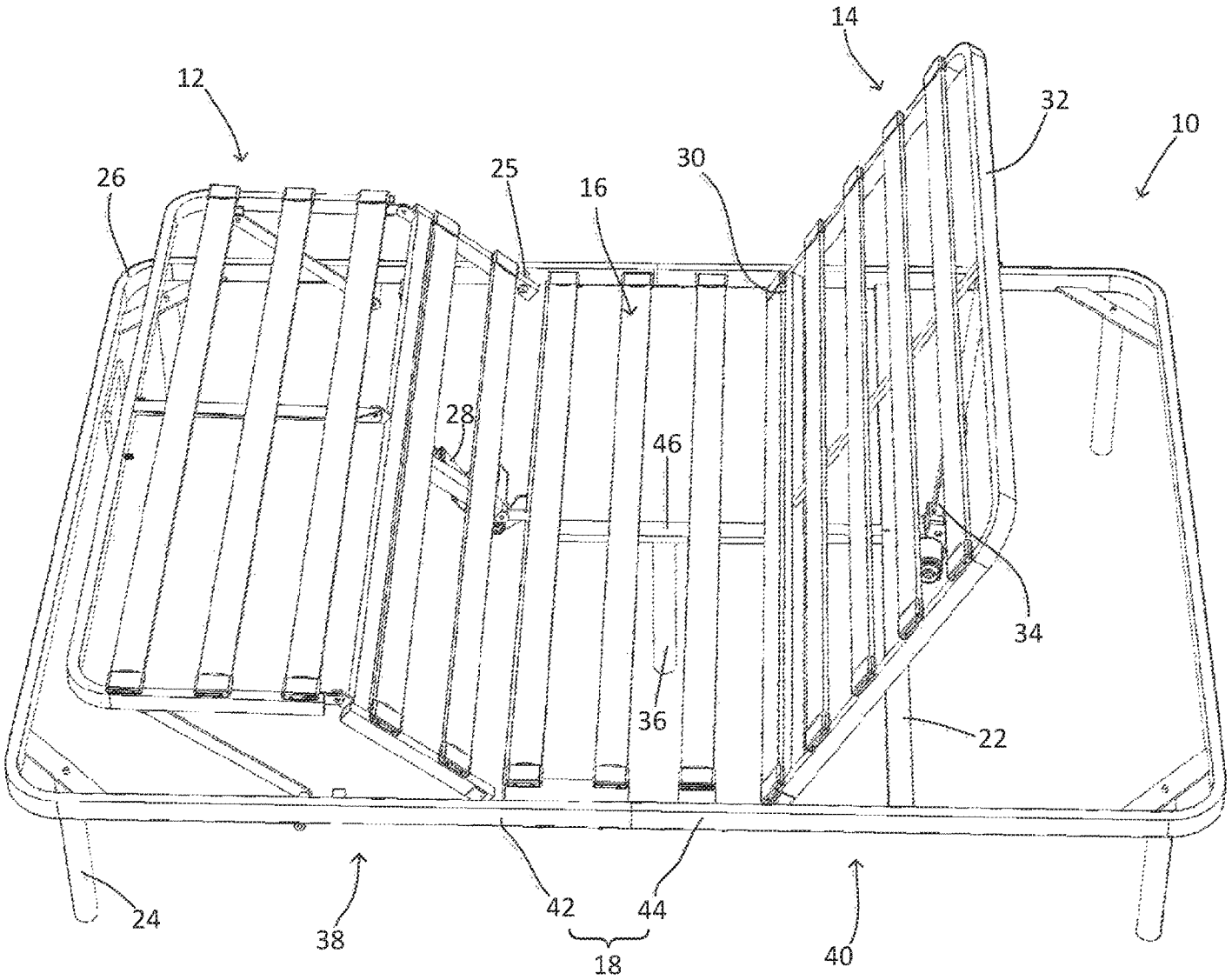
FIG. 1 is a top, perspective view of a motorized bed according to one embodiment of the present invention.

FIG. 1 is a top, perspective view of a motorized bed according to one embodiment of the present invention. The motorized bed generally includes a bed frame 10, a footrest 12 and a backrest 14 rotatably mounted to the bed frame 10, and a fixed section 16 fixed on the bed frame 10 and located between the footrest 12 and the backrest 14. The footrest 12, the backrest 14 and the fixed section 16 collectively form a platform supported on the bed frame 10. In use, a mattress (not shown) is generally placed on the platform and is caused to deform upon lifting or rotating of the footrest 12 and the backrest 14. Operation of such motorized bed is known in the art and, therefore, is not described herein in further detail.

The bed frame 10 includes a frame body 18, a first cross bar 20 and a second cross bar 22 fixedly connected to the frame body 18, and supporting legs 24 arranged at corners of the frame body 18. In the illustrated embodiment, the frame body 18 is substantially rectangular in shape. The frame body 18 has a pair of opposite long bars and a pair of opposite short bars. The first cross bar 20 is bridged between the long bars near a foot end of the bed, and the second cross bar 22 is bridged between the long bars near a head end of the bed. The long bars and short bars of the frame body 18, and the first and second cross bars 20, 22 can be all tubular.

The footrest 12 has a mounting end 25 and an opposite free end 26. Opposite sides of the mounting end 25 of the footrest 12 are rotatably mounted to the long bars of the frame body 18, respectively, which allows for rotation of the footrest 12 relative to the bed frame 10. A footrest actuator 28 is mounted to the first cross bar 20 and configured to drive the footrest 28 to rotate relative to the bed frame 10. The footrest actuator 28 connects to the first cross bar 20 at a first fixation point 29 that is located at a substantially middle portion of the first cross bar 20.

The backrest 14 has a mounting end 30 and an opposite free end 32. Opposite sides of the mounting end 30 of the backrest 14 are rotatably mounted to the long bars of the frame body 18, respectively, which allows rotation of the backrest 14 relative to the bed frame 10. A backrest actuator 34 is mounted to the second cross bar 22 and configured to drive the backrest 14 to rotate relative to the bed frame 10. The backrest actuator 34 connects to the second cross bar 22 at a second fixation point 35 that is located at a substantially middle portion of the second cross bar 22.

In the illustrated embodiment, four supporting legs 36 are arranged at four corners of the frame body 18 to support the bed. The supporting legs 36 depend from the frame body 18 or a connecting piece fixed to the frame body 18. In another embodiment, supporting legs may also be arranged at other locations along the frame body 18.

In the illustrated embodiment, for packaging reasons, the motorized bed is split in half, including a foot half 38 and a head half 40 fixedly connected to each other. This allows for compact packaging of the motorized bed, thus facilitating transportation of the motorized bed. In particular, the foot half 38 includes a generally U-shaped first bed frame section 42, the head half 40 includes a generally U-shaped second bed section 44, and the first bed frame section 42 and the second bed frame section 44 are coupled to form the substantially rectangular frame body 18. The first cross bar 20 is connected to the first bed frame section 42, and the second cross tube 22 is connected to the second bed frame section 44. Two supporting legs 36 are connected to the first bed frame section 42, and the other two legs 36 are connected to the second bed frame section 44.

When packaged for transportation, the foot half 38 and the head half 40 are separated and stacked in a packaging box with bottom sides of the foot half 38 and the head half 40 facing toward each other.

If the motorized bed is split in half, the footrest actuator 28 and the backrest actuator 34 are preferably offset from each other in a length direction of the motorized bed. In particular, the first fixation point 29 of the footrest actuator 28 on the first cross bar 20 is offset from the second fixation point 35 of the backrest actuator 34 on the second cross bar 22. Because of the offset design, the footrest actuator 29 on the foot half 38 and the backrest actuator 34 on the head half 40 do not interference with each other when the foot half 38 and the head half 40 are stacked in the packaging box, thus reducing the overall thickness of the package. It should be understood that the footrest actuator 28 and the backrest actuator 34 may also be aligned with each other in the length direction of the motorized bed.

A linkage part 46 is fixedly connected between the first cross bar 20 and the second cross bar 22 and located beneath the fixed section 16. Preferably, the linkage part 46 is located at a substantially middle area of the motorized bed and in line with one of the first fixation point 29 and the second fixation point 35 while being offset from the other of the first fixation point 29 and the second fixation point 35. In the illustrated embodiment, the linkage part 46 is in line with the second fixation point 35 while being offset from the first fixation point 29. In an alternative embodiment not illustrated, the linkage part 46 connects to the first cross bar 20 at a connection point close to the first fixation point 29 and connects to the second cross bar 22 at a connection point close to the second fixation point 35.

Figure 2:
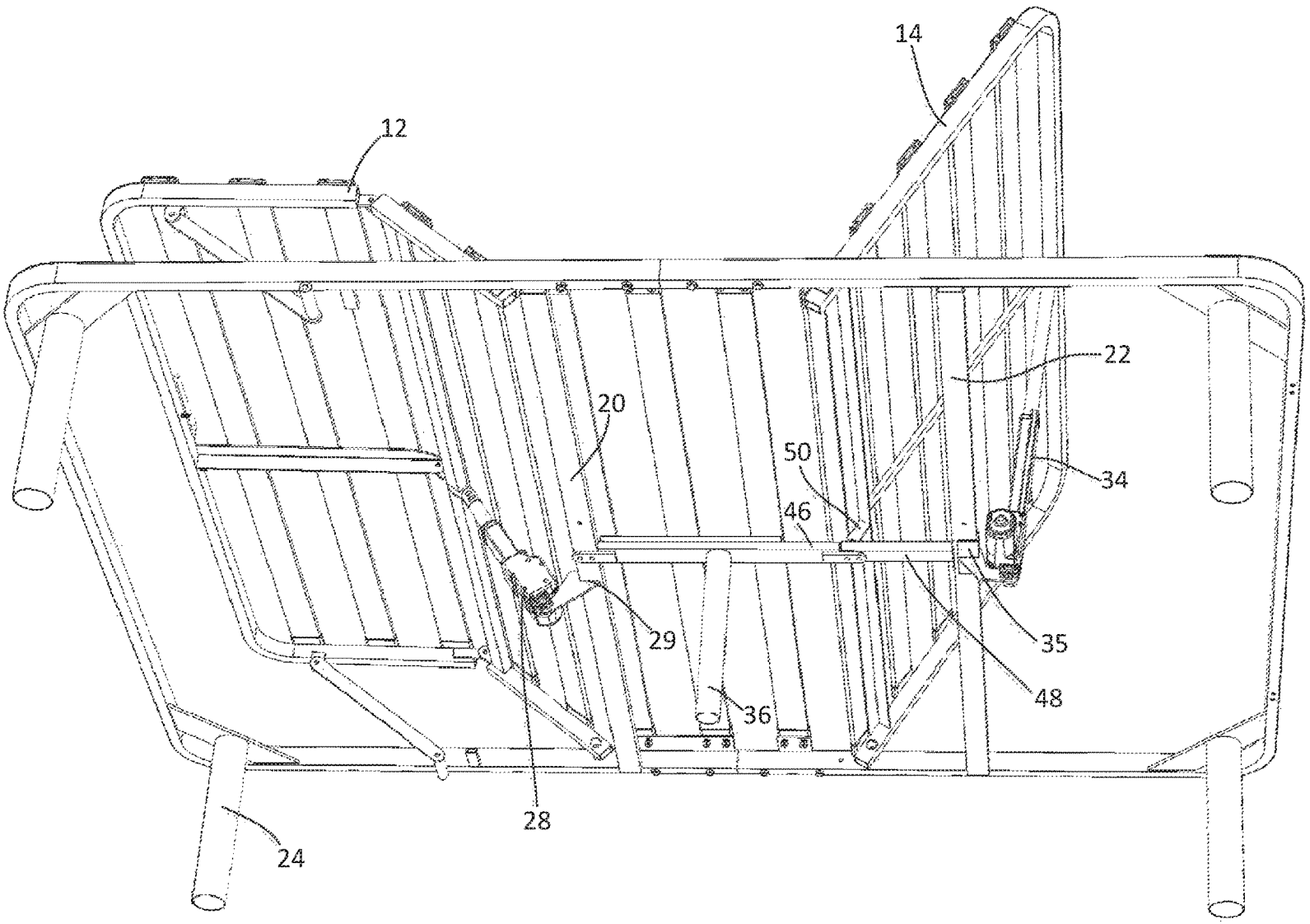
FIG. 2 is a bottom, perspective view of the motorized bed of FIG. 1.

In the embodiment illustrated in FIG. 1 and FIG. 2, the second cross bar 22 includes an extension 48 extending from a substantially middle portion thereof toward the first cross bar 20. A supporting piece 50 fixedly connected with a substantially middle portion of the mounting end 30 of the backrest 14 is rotatably connected with the extension 48. This provides an extra joint in the middle of the backrest 14 to increase the support strength of the backrest 14, which is especially advantageous for wide backrest 14. In this embodiment, the extension 48 is welded on the second cross bar 22 and may also be tubular. The linkage part 46 has one end fixedly connected to the first cross bar 20 and the other end fixedly connected to the extension 48. The linkage part 46 can be tubular and can be end-to-end connected to the extension 48.

In the embodiment of FIG. 1 and FIG. 2, the function of the extension 48 is to provide an extra joint in the middle of the backrest 14, and the extension 48 is welded on the second cross bar 22. Therefore, the extension 48 becomes an integral part of the second cross bar 22. In some embodiments, for example the embodiment of FIG. 1 and FIG. 2, it may be sufficient to put the linkage part 46 between the first cross bar 20 and the extension 48, in which case the linkage part 46 is indirectly connected to the second cross bar 22 through the extension 48. It should be understood that the linkage part 46 can also reach from the first cross bar 20 directly to the second cross bar 22, such as in the embodiment of FIG. 3 discussed below. It should also be understood that the linkage part 46 can still reach from the first cross bar 20 directly to the second cross bar 22 even if the extension is provided. In this case, the linkage part 46 is not connected to the extension 46 but rather directly connected to the second cross bar 22.

Figure 3:
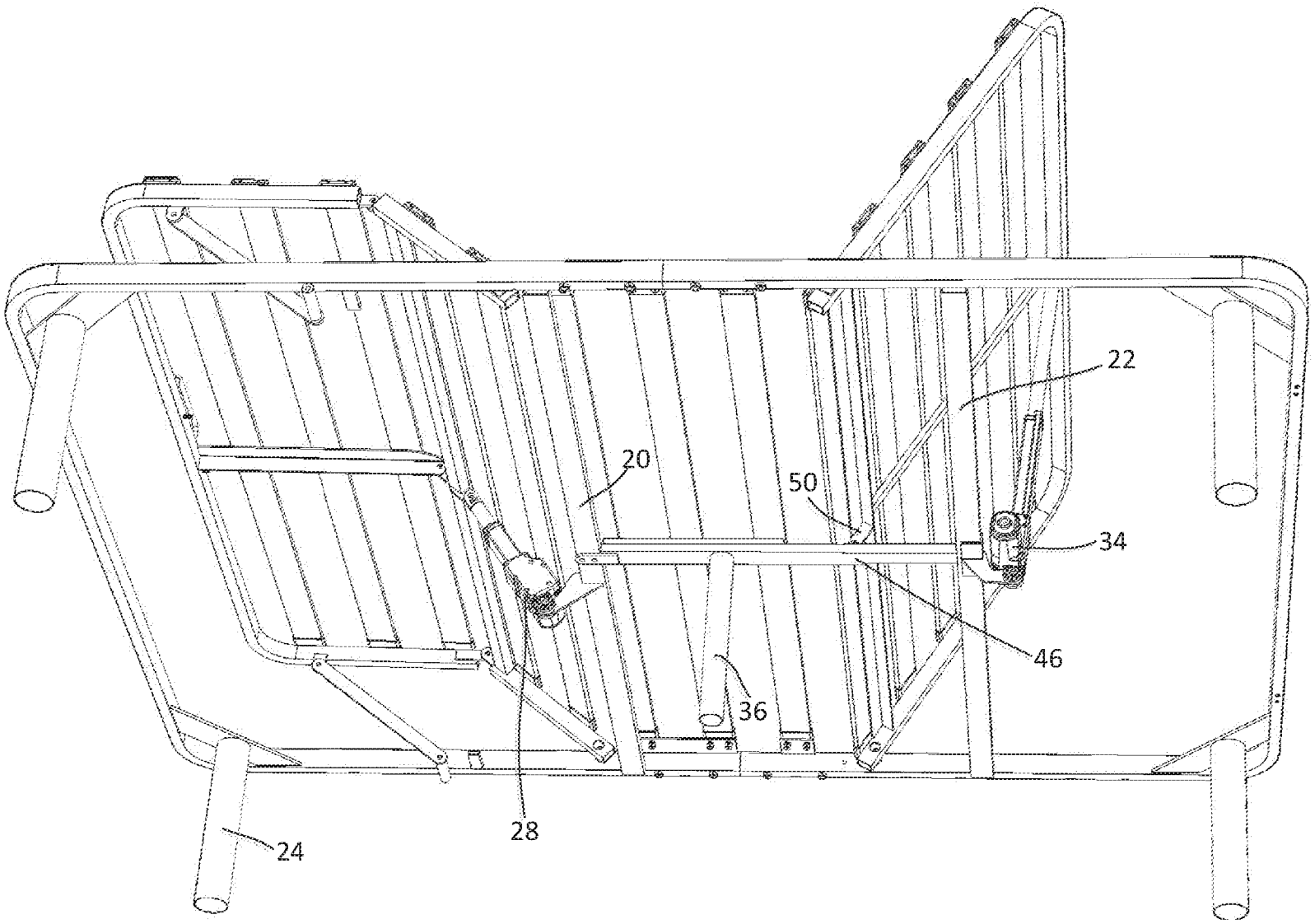
FIG. 3 is a bottom, perspective view of a motorized bed according to another embodiment of the present invention.

In another embodiment illustrated in FIG. 3, the linkage part 46 reaches from the first cross bar 20 directly to the second cross bar 22. That is, one end of the linkage part 46 is fixedly connected with the first cross bar 20, and the other end is fixedly connected with the second cross bar 22. The supporting piece 50 fixedly connected with the substantially middle portion of the mounting end 30 of the backrest 14 is rotatably connected with the linkage part 46. Likewise, this provides an extra joint in the middle of the backrest 14 to increase the support strength of the backrest 14. In this embodiment, one end of the linkage part 46 is fixedly connected to the first cross bar 20, and the other end is fixedly connected to the second cross bar 22.

While the motorized bed is illustrated as providing an extra joint in the middle of the backrest in the above embodiments, it should be understood that a motorized bed in accordance with an alternative embodiment of the present invention can have no such extra joint. For example, for a bed with small width or having a backrest itself capable of providing sufficient support, the extra joint is not needed.

Figure 4:
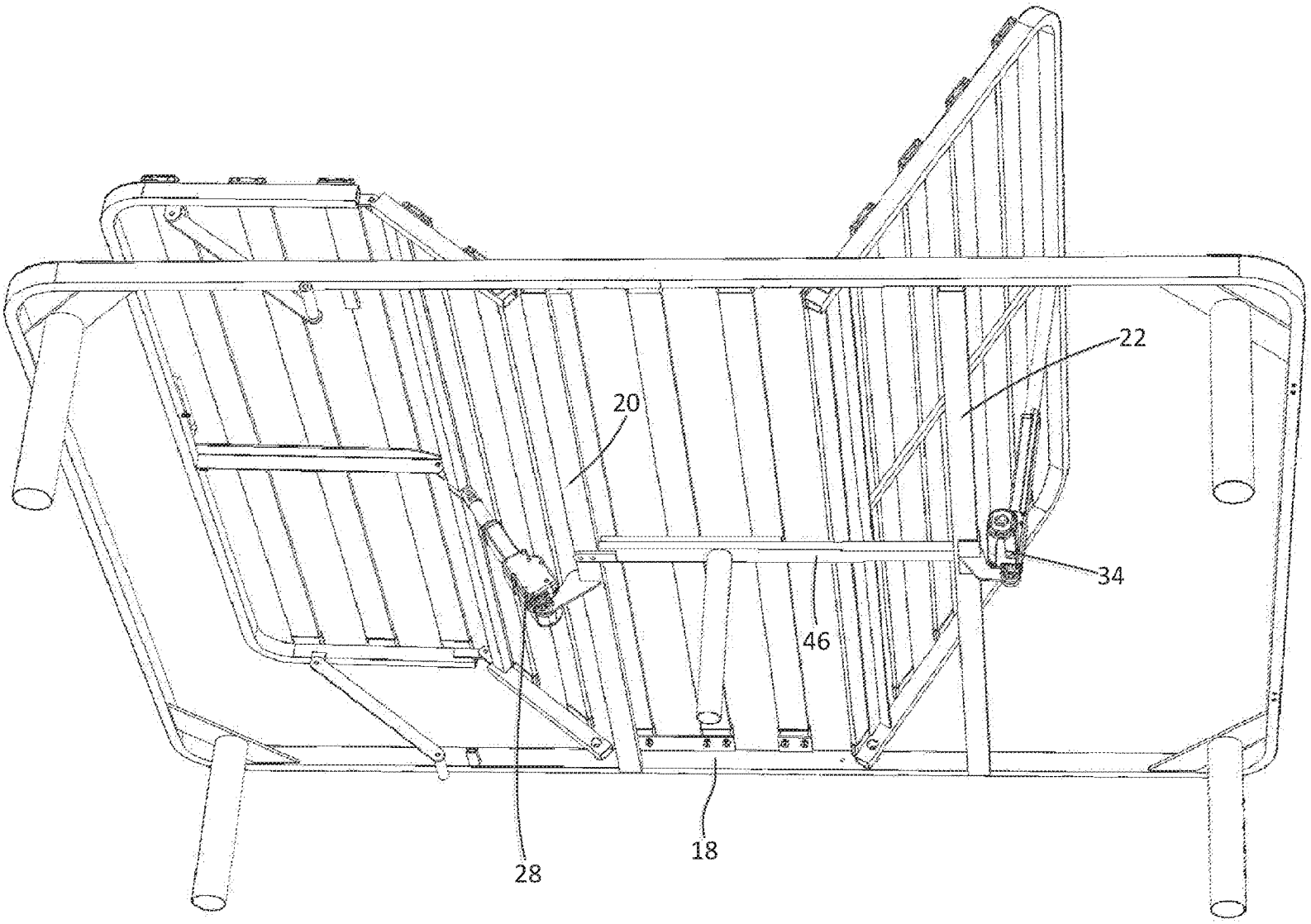
FIG. 4 is a bottom, perspective view of a motorized bed according to still another embodiment of the present invention.

FIG. 4 illustrates another embodiment of the motorized bed. In this embodiment, the long side of the frame body 18 is an integral piece. That is, the motorized bed is not split into the foot half and head half during transportation. In addition, the linkage part 46 reaches from the first cross bar 20 to the second cross bar 22. That is, one end of the linkage bar 46 is fixedly connected with the first cross bar 20, and the other end is fixedly connected with the second cross bar 22. Different from the above embodiments, no extension is formed on the second cross bar 22 and, therefore, no extra joint is provided in the middle of the backrest of the motorized bed of this embodiment.

With the provision of the additional linkage part 46, a force introduced by either of the footrest actuator 28 and the backrest actuator 34 is supported by both of the first cross bar 28 and the second cross bar 34. Also, the forces introduced by the two actuators 28, 34 on their respective cross bars 20, 22 are in opposite directions and they mainly neutralize each other through the linkage part 46. The provision of the linkage part 46 can increase the structural strength of the bed frame. Therefore, even the wall thickness of the cross bars is reduced in order to reduce cost, the bed frame can still provide acceptable support strength.

If the linkage part 46 and the actuators are placed in or close to the middle of the motorized bed, the linkage part 46 allows an additional supporting leg 52 to be placed in the middle to support a middle portion of the bed. Therefore, even if the additional supporting leg is desired, it can be placed in the interior of the bed, which looks nicer and is cheaper compared to the additional leg added to the middle of each outside of the conventional bed.

While the linkage part 46 is illustrated as being in or close to the middle of the motorized bed in the embodiments above, it should be understood that other locations of the linkage part 46 are possible as long as it can provide enhanced support strength. Therefore, the locations of the linkage part 46 described herein are illustrative rather than restrictive. In addition, while only one linkage part 46 is illustrated in the embodiments above, it should be understood that there may be more than one linkage part connected between the first and second cross bars.

Although the invention is described with reference to one or more embodiments, it will be apparent to those skilled in the art that various modifications and variations can be made to the disclosed structure without departing from the scope or spirit of the invention. In view of the foregoing, it is intended that the present invention cover modifications and variations of this invention provided they fall within the scope of the following claims and their equivalents.

What is claimed is:

1. A motorized bed comprising:

a bed frame comprising a first cross bar and a second cross bar;

a footrest rotatably mounted to the bed frame, the footrest comprising a mounting end rotatably mounted to the bed frame and an opposite tree end, the free end of the footrest located closer to the first cross bar than the second cross bar;

a footrest actuator mounted between the footrest and the first cross bar and configured to drive the footrest to rotate relative to the bed frame;

a backrest rotatably mounted to the bed frame, the backrest comprising a mounting end rotatably mounted to the bed frame and an opposite lice end, the free end of the backrest located closer to the second cross bar than the first cross bar;

a backrest actuator mounted between the backrest and the second cross bar and configured to drive the backrest to rotate relative to the bed frame; and a linkage part fixedly connected between a middle of the first cross bar and the second cross bar such that one of the backrest actuator and the footrest actuator is substantially in line with the linkage part in a way a force introduced by either of the footrest actuator and the backrest actuator is supported by both of the first cross bar and the second cross bar, wherein the second cross bar comprises an extension extending from a substantially middle portion thereof toward the first cross bar, a supporting piece fixedly connected with a substantially middle portion of the mounting end of the backrest is rotatably connected with the extension, and the linkage part is fixedly connected with the extension.

2. The motorized bed of claim 1, wherein the linkage part is located at a middle area of the motorized bed in a transverse direction of the motorized bed.

3. The motorized bed of claim 1, wherein the footrest actuator and the backrest actuator are offset from each other in a length direction of the motorized bed.

4. The motorized bed of claim 3, wherein the footrest actuator connects to the first cross bar at a first fixation point, the backrest actuator connects to the second cross bar at a second fixation point, and the linkage part is in line with one of the first fixation point and the second fixation point while being offset from the other of the first fixation point and the second fixation point.

5. The motorized bed of claim 4, wherein the linkage part is in line with the second fixation point while being offset from the first fixation point.

6. The motorized bed of claim 3, wherein the footrest actuator connects to the first cross bar at a first fixation point, the backrest actuator connects to the second cross bar at a second fixation point, the linkage part connects to the first cross bar at a connection point close to the first fixation point and connects to the second cross bar at a connection point close to the second fixation point.

7. The motorized bed of claim 1, wherein the motorized bed further comprises a fixed section between the footrest and the backrest, the fixed section is fixedly mounted on the bed frame, and the linkage part is located beneath the fixed section.

8. The motorized bed of claim 1, wherein each of the first and second cross bars and the linkage part is tubular.

9. The motorized bed of claim 1, wherein the linkage part and the extension are both tubular and are end-to-end connected to each other.

10. A motorized bed comprising:

a bed frame comprising a first cross bar and a second cross bar;

a footrest rotatably mounted to the bed frame, the footrest comprising a mounting end rotatably mounted to the bed frame and an opposite free end, the free end of the footrest located closer to the first cross bar than the second cross bar;

a footrest actuator mounted between the footrest and the first cross bar and configured to drive the footrest to rotate relative to the bed frame;

a backrest rotatably mounted to the bed frame, the backrest comprising a mounting end rotatably mounted to the bed frame and an opposite free end, the free end of the backrest located closer to the second cross bar than the first cross bar;

a backrest actuator mounted between the backrest and the second cross bar and configured to drive the backrest to rotate relative to the bed frame; and a linkage part fixedly connected between a middle of the first cross bar and the second cross bar such that one of the backrest actuator and the footrest actuator is substantially in line with the linkage part in a way a force introduced by either of the footrest actuator and the backrest actuator is supported by both of the first cross bar and the second cross bar, wherein the linkage part reaches from the first cross bar directly to the second cross bar; and wherein a supporting piece fixedly connected with a substantially middle portion of the mounting end of the backrest is rotatably connected with the linkage part.

11. A motorized bed comprising:

a bed frame comprising a substantially rectangular frame body, a first cross bar and a second cross bar connected to the frame body, and supporting legs arranged at corners of the frame body;

a footrest rotatably mounted to the frame body, the footrest comprising a mounting end rotatably mounted to the bed frame and an opposite free end, the free end of the footrest located closer to the first cross bar than the second cross bar;

a footrest actuator mounted to the first cross bar and configured to drive the footrest to rotate relative to the bed frame;

a backrest rotatably mounted to the bed frame, the backrest comprising a mounting end rotatably mounted to the bed frame and an opposite free end, the free end of the backrest located closer to the second cross bar than the first cross bar;

a backrest actuator mounted to the second cross bar and configured to drive the backrest to rotate relative to the bed frame;

a linkage part having one end fixedly connected to the first cross bar and the other end fixedly connected to the second cross bar, the linkage part located at a substantially middle area of the motorized bed; and an additional leg connected to the linkage part to support the substantially middle area of the motorized bed.

12. The motorized bed of claim 11, wherein the footrest actuator and the backrest actuator are offset from each other in a length direction of the motorized bed, the footrest actuator connects to the first cross bar at a first fixation point, the backrest actuator connects to the second cross bar at a second fixation point, and the linkage part is in line with one of the first fixation point and the second fixation point while being offset from the other of the first fixation point and the second fixation point.

* * * * *